US005779809A

United States Patent [19]

Sangeeta

[11] Patent Number: 5,779,809

[45] Date of Patent: Jul. 14, 1998

[54] METHOD OF DISSOLVING OR LEACHING CERAMIC CORES IN AIRFOILS

[75] Inventor: D. Sangeeta, Niskayuna, N.Y.

[73] Assignee: General Electric Company, Schenectady, N.Y.

[21] Appl. No.: 578,799

[22] Filed: Dec. 26, 1995

[51] Int. Cl.[6] ..... B08B 3/10

[52] U.S. Cl. ..... 134/2; 134/19; 134/22.13; 134/22.14; 134/29; 164/132

[58] Field of Search ..... 134/2, 19, 22.13, 134/22.14, 22.19, 29, 30; 164/132; 216/101; 252/79.1

[56] References Cited

U.S. PATENT DOCUMENTS

| | | | |
|---|---|---|---|
| 3,694,264 | 9/1972 | Weinland et al. | 134/22.14 X |
| 3,727,670 | 4/1973 | Bailey | 164/132 |
| 4,073,662 | 2/1978 | Borom | 164/132 X |
| 4,102,689 | 7/1978 | Borom | 164/132 X |
| 4,119,437 | 10/1978 | Arendt et al. | 164/132 X |
| 4,134,777 | 1/1979 | Borom | 134/2 |
| 4,141,781 | 2/1979 | Greskovich et al. | 156/637 |
| 4,569,384 | 2/1986 | Mills | 164/132 X |
| 5,332,023 | 7/1994 | Mills | 164/132 |

OTHER PUBLICATIONS

1954 Supplement to the "Metal Cleaning Bibliographical Abstracts" prepared by J.C. Harris, p. 20.

"Metal Cleaning Bibliographical Abstracts"s 1842–1951, prepared by Jay C. Harris, pp. 41 & 98.

*Primary Examiner*—Jill Warden
*Assistant Examiner*—Saeed Chaudhry
*Attorney, Agent, or Firm*—Noreen C. Johnson; William H. Pittman

[57] ABSTRACT

A process for removing, leaching, or dissolving ceramic cores used to maintain dimensional tolerances for internal passages during metal casting operations of hollow airfoils. The process is especially suited for dissolving porous ceramic cores, such as alumina, silica, alumina doped with oxides, and combinations thereof, that are used in internal passages in turbine airfoils during metal casting operations.

12 Claims, 1 Drawing Sheet

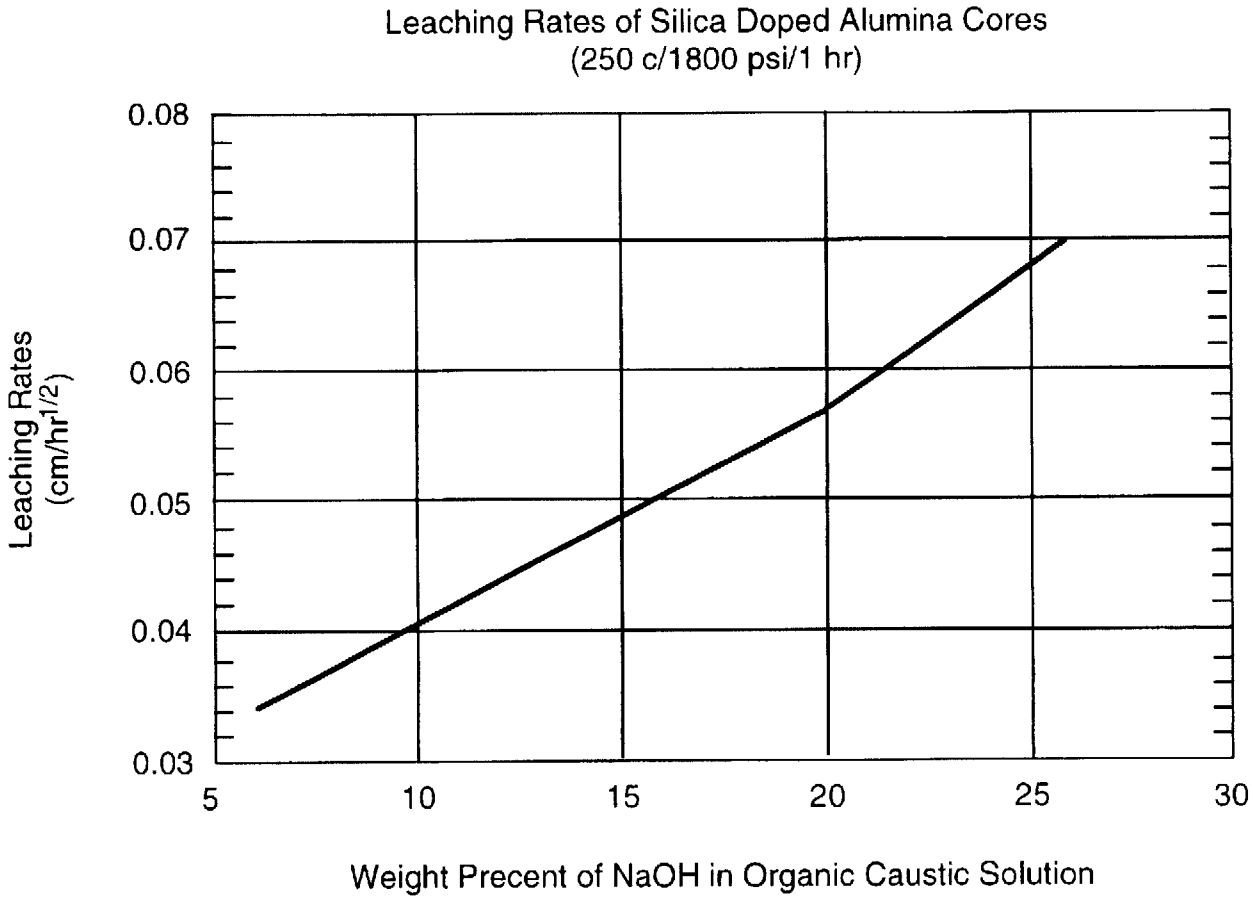
Leaching Rates of Silica Doped Alumina Cores
(250 c/1800 psi/1 hr)
Leaching Rates
(cm/hr1/2)
0.08
0.07
0.06
0.05
0.04
0.03
5
10
15
20
25
30
Weight Precent of NaOH in Organic Caustic Solution

METHOD OF DISSOLVING OR LEACHING CERAMIC CORES IN AIRFOILS

FIELD OF THE INVENTION

The present invention relates to a method of leaching or dissolving ceramic cores during airfoil manufacturing. Particularly, the invention relates to the chemical dissolution of single and mixed porous ceramic oxide cores in hollow airfoil castings in organic caustic solutions during an autoclave treatment.

BACKGROUND OF THE INVENTION

Efforts to achieve higher performance in turbine engines are limited by the ceramic materials used in the precision casting of hollow, high pressure turbine engine airfoils. Process requirements calling for casting temperatures and times greater than 1700° C. and sixteen hours, respectively, exceed permissible ceramic/molten metal contact parameters.

Generally, the ceramic used for cores must also be able to serve as the material for the casting mold and the internal-cooling-passage-defining core. To serve as a core, the material must additionally be removable from the casting by a process benign to the alloy. Alumina has been recognized as thermochemically compatible with the advanced alloys, but it has not been considered a viable candidate because of its difficulty in removing it from castings. The current airfoil or blade manufacturing process utilizes silica cores which are easier to leach out after alloy casting. The use of silica cores is limited when precision and definition of the internal passage is needed.

The use of alumina cores is desirable since alumina is more robust and can provide better dimensional tolerances in internal passages in airfoils. However, the current process used to leach or dissolve silica cores is not efficient when used on alumina cores. This is because the leaching rate for alumina cores is longer and time consuming, making it economically unfeasible for production and manufacturing operations. Also, the current leaching process poses a danger of increased caustic concentration during the leaching process thereby attacking the base metal and causing stress corrosion. The increase in the caustic concentration may arise from uncontrolled release of steam during venting steps in the current process.

Ceramic cores can be leached in fused-salt baths at reasonable leaching rates, for example, $Y_2O_3$, $Y_3Al_5O_{12}$, and $LaAlO_3$ with densities less than 90%, can be leached at 0.14 cm $hr^{-1/2}$ in $Li_3AlF_6$ at 1000° C. However, the diffusion controlled nature of the process and the technological problems associated with the operation of fused-salt baths make fused-salt leaching an undesirable choice as a core-removal technique.

Thus, there is a need for a process to leach and remove porous alumina cores after alloy casting that allows fine dimensional tolerances in internal passages in airfoils to be achieved. There is also a need for a process to remove alumina from cores that eliminates the risk of attacking the substrate metal or alloy while utilizing a leaching rate that is economically feasible for production schedules. Current alumina cores consist of silica binders which lower the leaching rate thereby increasing the process time. Hence, there is a need for a more effective leaching process for alumina and doped alumina cores that can dramatically increase the leaching rates. Still further, there is a need for a closed process system which will limit accidental release of chemicals during the leaching process.

SUMMARY OF THE INVENTION

This invention satisfies the needs by providing a method to leach or dissolve porous ceramic oxide cores used in precision casting of hollow turbine airfoils comprising the step of: soaking the oxide cores of he airfoils in an organic caustic solution in an autoclave at a temperature and pressure sufficient to lower the surface tension of the organic caustic solution for a period of time to completely remove all of the oxide cores from the airfoils. In addition to blades, internal passages of other turbine parts that require ceramic cores for manufacturing can also use the method of this invention to leach or dissolve oxide cores. The oxide cores may be alumina, mixtures of oxides containing aluminum or other metals, silica, or other porous oxide materials generally used for cores in manufacturing of turbine parts. Herein, the term "airfoil" is interhangeable with the term "turbine part".

In another aspect of this invention, there is provided a method for completely removing porous ceramic cores from metal parts which comprises leaching or dissolving the ceramic cores from the metal parts in an autoclave with an admixture consisting essentially of an organic solvent, a base, and water at a temperature, a pressure, and a time sufficient to completely dissolve the ceramic cores without damaging the metallic substrate used for the parts. The metal parts may be hollow turbine parts or other hollow metallic parts requiring internal passages where a ceramic core is used during manufacturing to maintain dimensional tolerances of the internal passages. Turbine parts can include blades, buckets, nozzles, vanes, and the like.

During the process it is beneficial, but not necessary, if the organic component of the organic caustic solution acts as a supercritical fluid. By supercritical fluid it is meant that the liquid is above its critical temperature and pressure where the surface tension of the organic solution is near or about zero.

Organic caustic solutions comprise chemical admixtures of an organic compound, such as an alcohol, a basic compound, such as an hydroxide base, and water. The ratio of base to water may be about one to one (1:1), or fifty weight percent base in water. The organic compound, generally a solvent to reduce surface tension of the solution, such as ethanol, must be present in a sufficient amount to cause all of the oxide core to be leached, dissolved, and removed from the metallic or turbine part.

An advantage of the invention is that the risk of damaging the substrate metal of the turbine part by the leaching process is almost eliminated. The leaching process of this invention can also be used for silica cores as well, and in fact, may be better than the present process being used on silica cores. Another advantage is that alumina cores, which provide better dimensional tolerances in the casting operations of blades, turbine parts, and other metallic parts requiring internal passages, can be completely removed after casting by this leaching process. Still another advantage of this invention may be that the dissolution rate of alumina is economically feasible in a manufacturing operation.

BRIEF DESCRIPTION OF THE DRAWINGS

FIG. 1 is a plot of the leaching rates of ceramic (silica doped alumina) cores (approximately 55–65% of theoretical density of alumina) as a function of the caustic concentration.

DESCRIPTION OF THE INVENTION

The invention is directed towards a wet chemical process for removing, leaching, or dissolving ceramic cores used to maintain dimensional tolerances for internal passages during metal casting operations of metal parts. The process is especially suited for dissolving porous ceramic cores, such as alumina, silica, alumina doped with oxides, and combinations thereof, that are used in internal passages in turbine parts during metal casting operations. Examples of alumina doped with oxides are alumina doped with silica and alumina doped with magnesia.

The invention entails using an autoclave with an organic caustic solution to fully dissolve or leach porous ceramic cores. The term "porous ceramic core" is defined as a ceramic material, such as alumina, silica, or oxides having varying amounts of aluminum or other metals, which have a density less than, or equal to 90 percent. Preferably, the density of the ceramic core is about 50–70 percent of the theoretical density or the porosity of the ceramic core is at least about 10 percent, or preferably, about 30–50 percent porous.

Substrate metallic materials often used in turbine parts or airfoils for aircraft engines and power generation equipment may include nickel, chromium, or iron based superalloys. The alloys may be cast or wrought superalloys. Examples of such substrates are GTD-111, GTD-222, Rene 80, Rene 41, Rene 125, Rene 77, Rene 95, Inconel 706, Inconel 718, Inconel 625, cobalt-based HS188, cobalt-based L-605, and stainless steels.

The autoclave reactor is a pressure vessel and is built to withstand high pressures at high temperatures. Pressure in the system is elevated by heating the contents (reaction mixture) in the autoclave or by using an external source of compressed gases to overpressurize the vessel. The autoclave may be operated in batch fashion; that is, the ingredients of the caustic organic solution are charged, the unit is closed, and the charge is brought to the desired conditions of temperature and pressure. Continuous or semicontinuous operation can be undertaken if one or more of the reactants are continuously fed and products withdrawn.

In the autoclave, the temperature and pressure that is applied may cause the organic component of the organic caustic solution to become a supercritical fluid or have properties similar to that of a supercritical fluid. By supercritical fluid it is meant that the surface tension of the fluid is zero or approaches near zero which completely wets the surfaces in contact. The organic caustic solution does not have to be a supercritical fluid for the ceramic oxide core to be removed. However, if the organic component of the organic caustic solution is near or approaches a supercritical state in the autoclave reactor during treatment of the airfoil, the surface tension is dramatically reduced thus enhancing the activity of the organic caustic solution and its wettability towards the surfaces in contact for dissolving and leaching the ceramic core.

The organic caustic solution is generally an admixture of an organic compound, a base, and water. Other admixtures may also be used, such as acetone, liquid ammonia, or liquid carbon dioxide, provided they dramatically lower the surface tension of the fluid during treatment of the airfoil in the autoclave. Examples of organic compounds are alcohols, such as methanol, ethanol, propanol, isopropyl alcohol, and acetone and liquid carbon dioxide, liquid ammonia, and mixtures thereof. Examples of caustic compounds are sodium hydroxide, potassium hydroxide, ammonium hydroxide, lithium hydroxide, triethylamine (TEA), tetramethylammonium hydroxide (TMAH), and mixtures thereof. Use of additives, such as surfactants and chelates, to further reduce the surface tension of the caustic solution can be beneficial.

The caustic compound (the base) and water may be present in about a one to one ratio. The concentrations of the bases may range from very dilute, about one weight percent, to very concentrated, about sixty-five weight percent. The organic compound is usually present in a sufficient amount as a solvent media for the caustic solution to fully dissolve or leach the ceramic core. The amount also depends on the size of the autoclave reactor and the size of the part being processed. Commonly known engineering principles can be used to calculate various amounts of the organic compound that is sufficient with the caustic and water to remove the ceramic core from the internal passages after casting operations. Generally, the base is about 1–65 weight percent, the water is about 1–35 weight percent, and the organic compound is about 1–98 weight percent. A preferred weight percent for the caustic organic solution is about 6 weight percent base, 6 weight percent water, and about 88 weight percent organic compound.

The temperature and pressure that is used during treatment can vary, depending on the amount, the type, and the porosity of the ceramic oxide core to be removed and the capabilities of the autoclave reactor. The organic caustic treatment can be performed at a range of temperatures, pressures, and reaction times. For example, the treatment may involve combinations of ultrasonication, mechanical mixing, and boiling with an autoclave treatment. The autoclave treatment can be conducted under several conditions. For instance, the pressure can range from about 100 pounds per square inch to about 3000 pounds per square inch, and the temperature can range from about 150° C. to 250° C. Also, pressurization can be achieved at room temperature using compressed gases. Higher pressures and temperatures can be applied to achieve shorter process times. Still yet, the process can start with zero pressure and by increasing the temperature of the reaction mixture, the autoclave pressure automatically rises resulting from the increase in the vapor pressure of the reaction mixture. The time to remove the ceramic core depends on the amount to be removed, the porosity of the ceramic, and the temperature and pressure conditions that are applied. Also, it should be noted that using a mixer, such as a mechanical stirrer, a magnetic stirrer, or an ultrasonicator, at low pressures or high pressures may enhance the ability of the organic caustic solution to remove the ceramic cores fully in a shorter duration of time.

The following examples further serve to demonstrate the present invention.

EXAMPLES

Alumina core samples consisting of small amounts of silica originating from the silica binder used during core fabrication were used to demonstrate the core leaching by the organic caustic process. For the purposes of the invention, these alumina cores are defined as silica doped alumina cores.

Example 1: 6 weight percent sodium hydroxide (NaOH) in the organic caustic solution at 250° C., 1800 psi for one hour:

An alumina core sample (approximately 50–60% of the theoretical density) was placed in a Monel autoclave and submerged in a solution containing 20 grams of NaOH, 20 grams of water, and 330 milliliter of ethanol. After sealing the pressure vessel, the temperature was raised to 250° C. with a resultant increase in pressure to approximately 1800 psi. The temperature and pressure conditions were maintained for approximately an hour. After the autoclave was cooled the samples were removed and cleaned (sonicated) in a three step process, including water cleaning, acid neutralization (5% HCl solution) of base, followed by water cleaning.

After the sample was dried, the change in dimensions and weight of the sample was noted (see Table 1).

TABLE 1

| Attributes | Before the Organic Caustic Treatment | After the Organic Caustic Treatment | Change (% Change) |
|---|---|---|---|
| Sample Weight | 0.3455 g | 0.2996 g | 0.0459 g (13.5%) |
| Sample Length | 0.8763 cm | 0.8712 cm | 0.005 cm (0.5%) |
| Sample Height | 0.4724 cm | 0.4420 cm | 0.030 cm (6.4%) |
| Sample Width | 0.4547 cm | 0.4343 cm | 0.023 cm (5.0%) |

The alumina core sample treated in the organic caustic solution was found to be fragile indicating a weight loss of approximately 14%. The leaching rate defined as the effective thickness of the material removed per unit time can be calculated from the data in Table 1. The leaching rate, K, is given by:

$$K=\Delta W/A\cdot t^{1/2}\cdot d \text{ in cm.hr}^{-1/2}$$

where, ΔW is the total weight loss (g), A is the initial surface area ($cm^2$), t is the leaching time (hr), and d is the specimen density (g/cc). The above formula provides leaching rates independent of sample sizes and shapes and fits well with the diffusion-controlled model for leaching processes. For the above sample the leaching rate was calculated to be approximately 0.0339 $cm.hr^{-1/2}$.

Example 2: 20 weight percent NaOH in the organic caustic solution at 250° C., 1800 psi for one hour:

An alumina core and a pure alumina tube (one inch long) samples, both approximately 50–70 percent of the theoretical density of alumina, were treated in a 20 weight percent organic caustic solution (68 g of NaOH, 68 g of water, and 204 g of ethanol) following the procedure given in example 1. The pure alumina tube completely dissolved and the leaching rate for the alumina core sample was calculated to be approximately 0.05654 $cm.hr^{-1/2}$ with a weight loss of approximately 41%. The core sample after the treatment was fragile with little or no mechanical integrity.

Example 3: 26 weight percent NaOH in the organic caustic solution/250 C/1800 psi/1 hr:

An alumina core and a pure alumina tube (one inch long) samples, both approximately 50–70 percent of the theoretical density of alumina, were treated in a 26 weight percent organic caustic solution (68 g of NaOH, 68 g of water, and 123 g of ethanol) following the procedure given in example 1. The pure alumina tube completely dissolved and the leaching rate for the alumina core sample was calculated to be approximately 0.0703 $cm.hr^{-1/2}$ with a weight loss of approximately 74%. The core sample after the treatment was fragile with little or no mechanical integrity.

The leaching rates of ceramic (silica doped alumina) cores as a function of the caustic concentration are plotted in the FIG. 1 exhibiting a linear relationship in the given caustic concentration range. However, it is expected that a pure alumina core will dissolve completely at all three caustic concentrations shown in FIG. 1. It is also expected that the alumina cores doped with magnesia (1–5 mole % of MgO) will have higher leaching rates at a given caustic concentration than alumina cores described here (silica doped alumina).

In comparison, the plain caustic (20 weight % NaOH in water at 290° C.) only dissolves pure alumina samples at higher temperatures (290° C. vs 250° C.) and in longer leaching times (4 hours or more). It is expected that the plain caustic solution at similar temperatures and pressures will exhibit lower leaching rates for alumina samples doped with silica.

What is claimed:

1. A method to leach or dissolve porous ceramic oxide cores used in precision casting of hollow turbine airfoils comprising the step of:

soaking the oxide cores of the airfoils in an organic caustic solution, consisting essentially of an organic solvent, a base, and water, where the organic caustic solution is about 1–98 weight percent organic solvent, about 1–65 weight percent base, and about 1–35 weight percent water, in an autoclave at a temperature and pressure sufficient to lower a surface tension of the organic caustic solution for a period of time to completely remove all of the oxide cores from the airfoils.

2. A method according to claim 1 where the ceramic oxide core is selected from the group consisting of alumina, silica, alumina doped with oxides, and mixtures thereof.

3. A method according to claim 2 where the alumina doped with oxide is alumina doped with silica or alumina doped with magnesia.

4. A method according to claim 1 where the porosity of the ceramic core is at least ten percent.

5. A method according to claim 4 where the porosity of the ceramic core is about 30–60 percent porous.

6. A method according to claim 1 where the organic solvent is selected from the group consisting of methanol, ethanol, propanol, isopropyl alcohol, acetone, liquid carbon dioxide, liquid ammonia, and mixtures thereof.

7. A method according to claim 1 where the base is selected from the group consisting of sodium hydroxide, potassium hydroxide, ammonium hydroxide, lithium hydroxide, triethylamine (TEA), tetramethylammonium hydroxide (TMAH), and mixtures thereof.

8. A method according to claim 1 where the organic solvent approaches a supercritical fluid state during the leaching of the ceramic cores in the airfoil in the autoclave.

9. A process according to claim 1 where the airfoil is a turbine part.

10. A process according to claim 9 where the hollow turbine part is selected from the group consisting of blades, buckets, nozzles, combustion chamber liners, and vanes.

11. A process according to claim 1 where the pressure is between about 100 psi to 3000 psi, and where the temperature is between about 150–250° C.

12. A method for completely removing porous ceramic cores from metal parts which comprises leaching or dissolving the ceramic cores from the metal parts in an autoclave with an admixture consisting essentially of an organic solvent, a base, and water at a temperature, a pressure, and a time sufficient to completely dissolve the ceramic cores without damaging a metallic substrate used for the parts.

* * * * *